US005095718A

United States Patent [19]

Ormond et al.

[11] Patent Number: 5,095,718

[45] Date of Patent: Mar. 17, 1992

[54] PORTABLE REFRIGERATION CASE FOR THE STORAGE AND DISPENSATION OF CANNED ITEMS

[76] Inventors: John J. Ormond, 4439 E. Hidalgo, Phoenix, Ariz. 85040; James R. Galloway, 8611-1 S. 48th St., Phoenix, Ariz. 85044

[21] Appl. No.: 609,645

[22] Filed: Nov. 6, 1990

[51] Int. Cl.[5] ..... F25D 3/08; A45C 11/20

[52] U.S. Cl. ..... 62/457.5; 206/545; 206/427; 206/433; 62/371

[58] Field of Search ..... 62/371, 372, 457.5, 62/457.7, 529, 530, 457.1; 220/3.1, 23.83, 93, 545, 427, 433

[56] References Cited

U.S. PATENT DOCUMENTS

| | | | |
|---|---|---|---|
| 705,551 | 7/1902 | Bauers | 220/23.83 |
| 2,399,787 | 5/1946 | Clerc | 62/371 |
| 2,496,296 | 2/1950 | Lobl | 62/371 |
| 2,792,980 | 5/1957 | Brown | 224/209 |
| 3,338,068 | 8/1967 | Piker | 62/371 |
| 4,441,336 | 4/1984 | Cannon | 62/457.5 |
| 4,449,378 | 5/1984 | Thorpe | 62/371 |
| 4,537,313 | 8/1985 | Workman | 62/457.1 |
| 4,628,705 | 12/1986 | Nave | 62/371 |
| 4,673,117 | 6/1987 | Calton | 220/3.1 |
| 4,721,237 | 1/1988 | Leslie | 224/148 |
| 4,826,060 | 5/1989 | Hollingsworth | 224/205 |
| 4,858,444 | 8/1989 | Scott | 62/372 |

*Primary Examiner*—Albert J. Makay
*Assistant Examiner*—William Doerrler

[57] ABSTRACT

A compartmentalized refrigeration case for cans of beverage and/or food with a handle and straps for portability by hand or over the shoulders. The refrigeration compartments in the interior of the case are formed by at least one horizontal layer of thermoplastic coated, removable, reusable, cooling units shaped to surround standard size beverage cans. The compartments are enclosed by multi-layer panels comprised of a thermally insulating and supportive foam sandwiched between an inner lining of waterproof material and an outer covering of water-resistant, durable fabric. Each refrigeration compartment is accessible through the front panel of the case by an insulated, door with a fastener such as VELCRO adjacent each compartment. This results in a convenient and versatile case, since every can in the case is accessible through one of the doors at all times. The case has an insulated, zippered top for access from the top of the case and a number of pockets on either side of the case that close at the top for carrying food or other items. Straps are attached to the bottom panel of the case for holding items such as towels, blankets, and shoes, which are too large to fit into the pockets.

20 Claims, 1 Drawing Sheet

PORTABLE REFRIGERATION CASE FOR THE STORAGE AND DISPENSATION OF CANNED ITEMS

BACKGROUND OF THE INVENTION

The particular invention relates to a portable cooler apparatus for the storage and dispensation of canned items. There have been various cooler chests that are thermally insulated and hold a number of beverage cans with various methods of cooling. An example is the portable cooler described in U.S. Pat. No. 4,721,237 to Leslie. Leslie's apparatus is configured as a simple box-like chamber with a coolant confining container holding the cans of beverage vertically. The cans are dispensed through a bottom door by means of gravity. The portable cooler described by Leslie is designed specifically for the purpose of cooling and dispensing cans stacked vertically, limiting its use to this purpose. Also, can selection (e.g., for the purpose of selecting different brands, flavors, types of goods, etc.) is limited due to the single dispensing aperture located at the bottom of the chamber. Further, it is questionable as to the amount of space necessary to accommodate the coolant container unit in a standard household freezer.

It is an object of the present invention to provide a refrigeration case which is waterproof and thermally insulated for use with one or more thermoplastic coolant units for the refrigeration of up to and including twelve cans of beverage, food, medical supplies, etc.

It is a further object of the invention to provide a refigeration case which has convenient, separate refrigeration compartments that are each easily accessable from a separate door adjacent the compartment and on the face of the case where items being cooled may easily be selectively removed from and inserted into the case.

It is another object of the invention to provide a refrigeration case which has removable, small coolant units that are easily stackable in a standard household freezer.

It is another object of the present invention to provide a refrigeration case which is portable and which may be carried by an individual using a top handle or in back-pack style using shoulder straps.

It is a further object of the invention to provide a refrigeration case constructed of the most-advanced, lightweight, durable, rugged, and waterproof materials on the market, while being both economically manufactured and stylish.

These objects and other objects and advantages of the present invention will be apparent from the following description.

SUMMARY OF THE INVENTION

The objects mentioned above and other beneficial objects and advantages are accomplished in accordance with the present invention by a portable cooling apparatus comprising:

(a) an enclosed case of rectangular shape having front, rear, bottom, top, and side panels and constructed of flexible, durable, waterproof urethane coated nylon fiber fabric (or other comparable material) on the exterior and flexible, waterproof, anti-bacterial, air tight, laminated fabric (or other comparable material) on the interior, the interior and exterior fabric enclosing a thermally insulated closed-cell foam therebetween, the panels being formed from the multiple layers of fabric and foam;

(b) an accessable, insulated top cover with zipper closure that opens to the inside of the case;

(c) prefabricated, thermoplastic coated cooling units shaped to fit cylindrical objects in multiples of three, the cooling units being supported on the interior of the case to form refrigeration compartments, and being removable for placement into a household freezer;

(d) fabric covered, thermally insulated doors adjacent each refrigeration compartment for providing access to the canned goods, the doors being attached on the front panel of the case along the top edge and sealed along the remaining three sides with a velcro-type fastening hook and loop fastening attachment such as VELCRO;

(e) pockets fabricated of fabric-like material for additional storage of items, the pockets being attached to opposing sides of the case with separate lid covers that close with a hook and loop fastening fabric;

(f) a handle made of sturdy polypropolene (or other suitable material) located at the top of the case above the zippered top cover and attached to each opposing side of the case;

(g) two padded, adjustable shoulder straps attached to the rear panel of the case for portability of the case on the shoulders of an individual; and (h) adjustable straps fabricated of polypropolene (or other suitable material) attached to the bottom panel of the case for carrying additional items too large for the case or pockets, or items that do not require cold storage.

In a preferred embodiment of the invention, the case is fitted with four prefabricated, thermoplastic cooling units vertically spaced such that the distance between them is approximately the diameter of a standard beverage can. The case includes three doors adjacent the refrigeration compartments formed between the cooling units. Hence, an individual may stock the case with a number of different brands of the same good and/or a number of different flavors of the same brand, and selectively remove the desired good or brand at any time. This provides added convenience and versatility of the refrigeration case of the present invention. While the preferred embodiment is described with a specific number of cooling units and doors, it should not be construed as limiting, as any number of cooling units and doors may be utilized within the scope of the invention.

BRIEF DESCRIPTION OF THE DRAWING

For a complete understanding of the nature and objects of the invention, reference should be made to the following detailed description of the invention taken in conjunction with the accompanying drawings which form a part of this specification and in which similar reference numerals indicate like parts in all the figures.

DESCRIPTION OF THE PREFERRED EMBODIMENT

Figure 1:
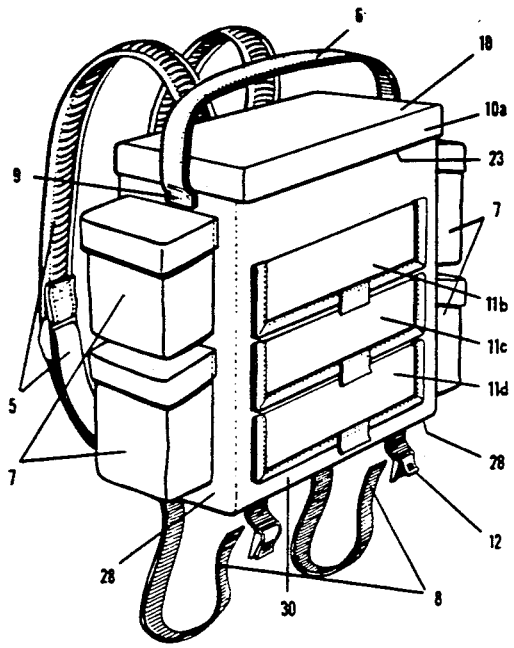
FIG. 1 is a front perspective view of a preferred embodiment of the refrigeration case of the present invention.

An embodiment of the compartmentalized refrigeration case is shown in FIGS. 1–4. The refrigeration case 1 is comprised of a refrigeration compartment 32 enclosed by at least one layer of insulating material 4 sandwiched between inner 22 and outer 21 fabric layers, and at least one coolant unit 2 dividing the refrigeration compartment 32 into multiple chambers.

Figure 4:
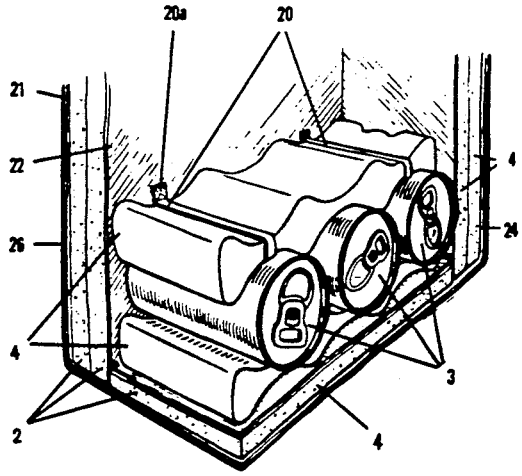
FIG. 4 is a detailed cutaway perspective view of the interior of the refrigeration case of FIG. 1 illustrating the prefabricated cooling units and support straps and the multi-layer construction of the panels.

Refrigeration compartment 32 is of box-like configuration with side 24, rear 26, bottom 28, and front 30 panels, forming a substantially rectangular shape. As shown in FIG. 4, the side panels 24 and the rear panel 26 are formed with a double layer of closed-cell insulating foam 4. The bottom panel 28 and the front panel 30, on the other hand, are formed with a single layer of closed-cell insulating foam 4. The insulating foam 4 may be fabricated of any of the wellknown thermally insulative materials, such as polyethylene and polystyrene.

The interior surface of the panels forming the refrigeration compartment 32 includes a fabric layer 22 fabricated of a flexible, waterproof, anti-bacterial, air-tight, laminated material, such as Herculite. The exterior surface of the panels includes a fabric layer 21 fabricated of a flexible, durable, waterproof, urethane-coated nylon fiber material, such as Cordura. The insulating foam 4 is sandwiched between the interior 22 and exterior 21 fabric layers, where it is protected from moisture and damage. While particular examples of fabric have been described for the interior and exterior layers, any comparable material having the properties mentioned could be utilized on the embodiment of the invention illustrated in FIGS. 1–4.

Figure 2:
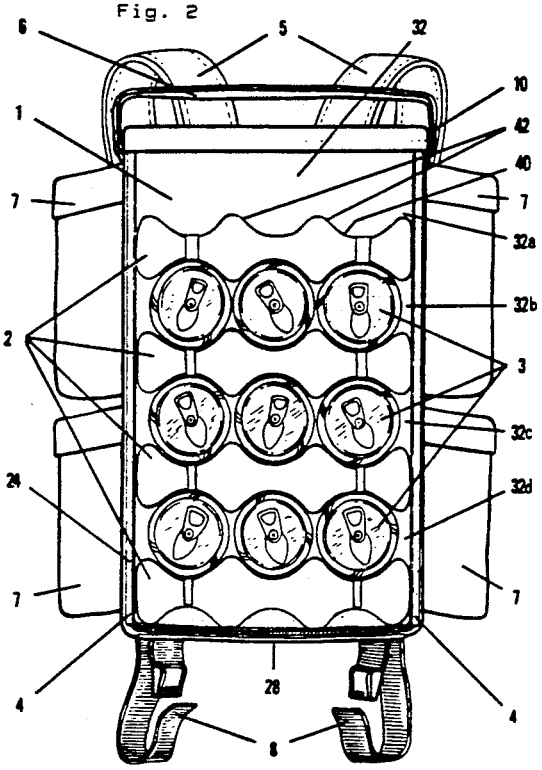
FIG. 2 is a frontal view of the refrigeration case of FIG. 1 with the front panel of the case removed to illustrate the internal details of the refrigeration compartments.

Prefabricated cooling units 2 are horizontally disposed within the refrigeration chamber 32, as best shown in FIG. 2. The cooling units 2 are thermoplastic coated structures, and hence are well suited to repeated freezing and thawing processes. The units have a serpentine contour which enables them to receive a standard size beverage can in a depression 40 located between successive peaks 42. The cooling units 2 are vertically spaced (between depressions 40) in the refrigeration compartment 32 approximately the distance corresponding to the diameter of a standard size beverage can. The area between adjacent cooling units 2 defines refrigeration chambers 32*b*–32*d*, and the area above the uppermost cooling unit 2 which is nearest the insulated top 10 defines refrigeration chamber 32*a*. As shown in FIGS. 2 and 4, the cans 3 are positioned in the refrigeration chambers between the depressions 40 of adjacent cooling units, where they are kept cold. Although the embodiment illustrated in FIG. 2 has four cooling units 2, each having three depressions 40, the refrigeration case may be provided with more units or fewer units than that shown and with more or fewer depressions than three.

Elastic straps 20 support the cooling units 2 in the refrigeration compartment 32. The ends 20*a* of the straps are sewn to the interior fabric layer 22. The elasticity of the straps 20 facilitate the insertion of the cooling units into and the removal of the cooling units from the refrigeration compartment 32. Ease of manipulation of the cooling units 2 is a must, since the cooling units must be removed to be frozen and then reinserted into the case.

Figure 3:
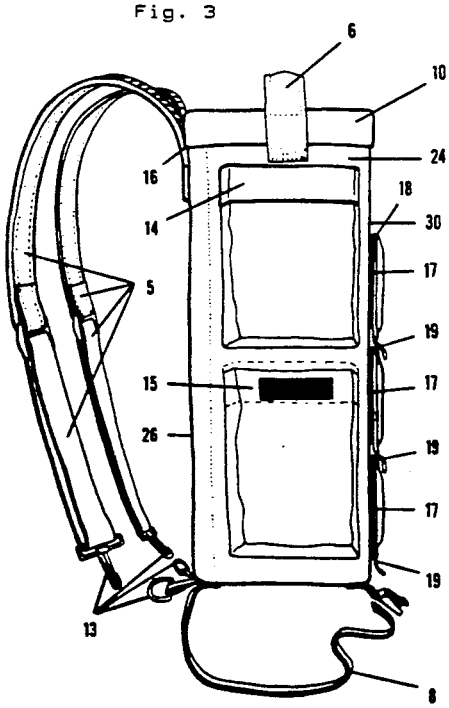
FIG. 3 is a side view of the refrigeration case of FIG. 1 illustrating the side pockets and the bottom carrying straps.

The front panel 30 of the refrigeration case 1 is provided with access doors 11*b*–11*d* adjacent corresponding refrigeration chambers 32*b*–32*d*. Each of the access doors 11*b*–11*d* is a fabric covered, thermally insulated closure member. As best shown in FIG. 3, the top edge 18 of the doors 11*b*–11*d* is folded over and sewn to the exterior fabric layer 21 to form a hinge about which the door is pivoted. The remaining three sides of the doors are sealed with a hook and loop fastening attachment 17 such as VELCRO to prevent ambient air from entering the refrigeration chamber 32. A pull tab 19 is permanently affixed to the bottom of each door to facilitate the opening of the door.

The refrigeration case 1 is provided with an insulated top cover 10 that has a nylon zipper closure 23 opening to the inside of the case. The cover 10 includes a fabric flap 10*a* extending around the perimeter of the cover which covers the nylon zipper. The cover 10 provides access to the uppermost refrigeration chamber 32*a*, where cans or other cold storage items may be inserted and removed. The fabric of the cover 10 is folded over and sewn to the case 1, forming a hinge 16 about which the door is pivoted.

Along opposing sides of the refrigeration case 1, pockets 7 are provided for items that do not require cold storage. The pockets (which are four in number in the embodiment shown in the drawing) are fabricated of fabric-like material, preferably of the same material comprising the exterior layer 21 of the case. The pockets 7 are permanently affixed to the side panels 24 by, for example, sewing. Covers 14 enclose the pockets 7, and may be fastened to the outside edge of the pockets with a hook and loop fastening attachment 15 such as VELCRO. The refrigeration case 1 is also provided with adjustable straps 8 made of polypropolene (or other comparable material). The straps are permanently affixed to the bottom panel 28 of the case. A pull-through closure 12 is affixed to the opposing side of the bottom panel 28, as shown in FIG. 3. The interaction of the straps 8 and the closures 12 permits the carrying of items, such as towels, blankets, and shoes, which are too large for the pockets 7.

For convenience the refrigeration case 1 includes both a handle 6 and padded shoulder straps 5. The handle 6 is fabricated of sturdy polypropolene (or other suitable material), and is sewn at 8 to the side panels 24, as shown in FIG. 1. The shoulder straps 5 are of adjustable length, and are attached by sewing to the rear panel 26. A hook and ring fastening arrangement 13 is provided for the shoulder straps to facilitate manipulation of the straps.

In operation, the cooling units 2 are removed from the elastic support straps 20 in the refrigeration compartment 32, and are then stacked in a household freezer where they will be frozen. Subsequent to the freezing of the substance in the units 2, the cooling units 2 are easily positioned in the refrigeration compartment 32 by stretching the elastic support straps 20 and feeding the units between the sewn ends. Cans or other items are then loaded into the refrigeration chambers 32*a*–32*d* through the top cover 10 and the access doors 11*b*–11*d*. When an individual desires to remove a can, the appropriate closure (i.e., the top cover 10 or the access doors 11*b*–11*d*) is opened, and the can is removed. Since each chamber 32*a*–32*d* is individually accessable through a designated closure, a particular can may be selected and removed. It should be noted that every item in the case is accessable at all times without requiring the movement of any other item.

While particular examples of the present invention have been shown and described, it is to be understood that changes and modifications may be made without departing from the true spirit and scope of the invention. The appended claims are intended to cover all such changes and modifications which fall within the spirit and scope of the invention.

Having described my invention, I claim:

1. A portable refrigeration case for multiple cans comprising:

(a) a box-like compartment formed from side, front, and rear panels arranged in a substantially rectangular configuration and a bottom panel attached to said side, front, and rear panels at right angles and a top member, said panels including an exterior layer of material, an interior layer of material, and another material layer between said exterior and interior material layers;

(b) at least two cooling units being horizontally disposed in said compartment and being spaced apart a predetermined vertical distance, said space between said cooling units defining a refrigeration chamber for storage of canned items, said cooling units having a serpentine contour comprising alternating peaks and depressions, wherein said depressions are of semi-circular shape for receiving said canned items and wherein each of said canned items is held in said refrigeration chamber between one of said depressions in each of said cooling units;

(c) support means for removably supporting said cooling units in said compartment, said support means being permanently affixed to said interior material layer of one of said panels; and (d) access door means adjacent said refrigeration chamber for providing access to the canned items in said refrigeration chamber.

2. The refrigeration case of claim 1 wherein said exterior material layer and said interior material layer are a fabric material and said another material layer is an insulating foam material.

3. The refrigeration case of claim 2 wherein said insulating foam material is a closed-cell insulating foam.

4. The refrigeration case of claim 1 wherein said another material layer is double layer of closed-cell insulating foam material in said side and rear panels.

5. The refrigeration case of claim 1 wherein said support means comprises at least two elastic straps which may be stretched to permit the insertion and the removal of said cooling units from said compartment.

6. The refrigeration case of claim 1 wherein said access door means is comprised of an insulated door.

7. The refrigeration case of claim 6 wherein said insulated door includes a pull tab proximate the bottom of the door, a pivot means proximate the top of the door, and sealing means along the sides and bottom of the door.

8. The refrigeration case of claim 7 wherein said sealing means is comprised of a hook and loop fastening attachment.

9. The refrigeration case of claim 1 wherein said at least two cooling units is three cooling units, said three cooling units being spaced apart said predetermined vertical distance, said space between said cooling units defining two refrigeration chambers for storage of canned items and wherein there is provided said access doors means adjacent each of said refrigeration chambers.

10. The refrigeration case of claim 9 wherein said access door means is comprised of two insulated doors.

11. The refrigeration case of claim 10 wherein said insulated doors each include a pull tab proximate the bottom of the door, a pivot means proximate the top of the door, and sealing means along the sides and bottom of the door.

12. The refrigeration case of claim 1 wherein said predetermined vertical distance is approximately the diameter of a standard size beverage can.

13. The refrigeration case of claim 1 wherein said at least two cooling units is four cooling units, said four cooling units being spaced apart said predetermined vertical distance, said space between said cooling units defining three refrigeration chambers for storage of canned items and wherein there is provided said access doors means adjacent each of said refrigeration chambers.

14. The refrigeration case of claim 13 wherein there is a fourth refrigeration chamber above the uppermost cooling unit with respect to said bottom panel.

15. The refrigeration case of claim 14 wherein said fourth refrigeration chamber is enclosed by said top member, and wherein said top member is an insulated cover.

16. The refrigeration case of claim 15 wherein said insulated cover includes a nylon zipper.

17. The refrigeration case of claim 1 further including pocket means for holding items not requiring cold storage, said pocket means being attached to said side panels.

18. The refrigeration case of claim 1 further including bottom straps attached to said bottom panel for holding large items.

19. The refrigeration case of claim 1 further including a handle attached to said side panels.

20. The refrigeration case of claim 1 further including adjustable shoulder straps attached to said rear panel.

* * * * *